United States Patent [19]

Frantz

[11] Patent Number: 5,074,533

[45] Date of Patent: Dec. 24, 1991

[54] ENDOTHERMIC FURNACE

[75] Inventor: Russel L. Frantz, Russellville, Ark.

[73] Assignee: Monroe Auto Equipment Company, Monroe, Mich.

[21] Appl. No.: 505,703

[22] Filed: Apr. 6, 1990 (Under 37 CFR 1.47)

[51] Int. Cl.[5] ..... C21D 1/06

[52] U.S. Cl. ..... 266/254; 266/252

[58] Field of Search ..... 266/81, 254, 255, 252, 266/249

[56] References Cited

U.S. PATENT DOCUMENTS

| | | | |
|---|---|---|---|
| 755,867 | 3/1904 | Gesner . | |
| 2,254,047 | 6/1941 | Roth . | |
| 2,589,811 | 3/1952 | Holcroft . | |
| 2,763,582 | 9/1956 | Rusciano . | |
| 3,517,916 | 6/1970 | Ross et al. | 266/254 |
| 4,174,097 | 11/1979 | Schwalm | 266/254 |
| 4,457,493 | 7/1984 | Takahashi | 266/81 |

OTHER PUBLICATIONS

"Powder Metallurgy Equipment Manual", Powder Metallurgy Equipment Association, Princeton, New Jersey, 12/1977.

*Primary Examiner*—S. Kastler

*Attorney, Agent, or Firm*—Harness, Dickey & Pierce

[57] ABSTRACT

An endothermic furnace for sintering metal includes a pair of U-shaped retort tubes which are mounted to the underside of a flat, rectangular lid, the lid being removably secured along the respective top vertical edges of the furnace chamber sidewalls and the retorts being removable with the lid. Each tube carries a catalyst and receives a carbonaceous gas mixture that is either combusted externally or internally of the chamber, the gas reacting with the catalyst to produce a desired endothermic gas product which heats each tube whereby to radiantly heat the chamber and which is piped back into the heat chamber, when cooled, to provide an oxygen-free atmosphere for the heat treating chamber.

22 Claims, 5 Drawing Sheets

ENDOTHERMIC FURNACE

BACKGROUND AND SUMMARY OF THE INVENTION

The present invention relates to an endothermic furnace providing a protective atmosphere for heating metals. More particularly, the instant invention relates to an improved furnace construction for sintering metal using an indirect radiant tube heater both as the source of heat and as the original source for or as the replenishing source of the endothermic atmosphere during treatment of the metal.

A metal heating furnace is characterized by the presence of a closed work area in which the work is heated to the temperature necessary to perform the metallurgical process. Heat can be achieved by using electric heating elements or the firing of indirect radiant tube heaters. If fired radiant tubes are used as the source of heat, the combustion products are conventionally vented to the atmosphere. In such processes, an atmosphere of very specific and controlled composition, taken from a source external to the furnace, is introduced into the heated work area in order to protect the work from undesirable metallurgical reaction such as oxidation, or to impart specific metallurgical characteristics to the work, for example carburizing or carbonitriding. This is very costly and an arrangement which recovers the combustion products for use as the furnace atmosphere would be desirable.

One object of the present invention is to take advantage of the combustion products present in the retort tubes and to utilize the combustion products by passing them through a catalyst in the retort to create an endothermic atmosphere which is used in the protection of the metals in the high temperature portion of the sintering furnace. The treated combustion products are used either as the carrier gas or as the protective atmosphere for the metallurgical process that is carried out in the furnace.

In accordance with this invention, furnace atmosphere gas is generated by the action of a catalyst which is located in each of a pair of elongated U-shaped retort tubes, each retort tube being supported from an elongated rectangular-shaped lid removably secured to the high heat chamber of the furnace and the high heat chamber of the furnace being externally heated to approximately 1900°-2200° F. (1040°-1200° C.). Air and gas external to the chamber are mixed, pressurized and then passed through the catalyst whereupon the mixture is combusted. An endothermic heat-absorbing reaction works on the heated combustion products to produce the desired furnace atmosphere gas. The completely reacted furnace atmosphere gas is rapidly cooled in a first cooler assembly to prevent the formation of soot. An array of finned selectively interconnected heat exchanger tubes define the cooler assembly with each retort tube having an outlet end thereof associated with an inlet to one heat exchanger tube to pass the gas through the related heat exchanger tubes. Thereafter the cooled gas is discharged from an outlet from another heat exchanger tube and returned to the work area of the furnace to provide a predetermined atmosphere for the metallurgical process.

In such process it is important that the furnace atmosphere not be contaminated and thus the work area of the furnace must be airtight. Should one of the U-shaped retort tubes crack during operation, removability of the lid allows for replacement of cracked tubes and replacement of the catalyst.

Positioning of the retort tubes on the lid such that the long dimension of each tube is parallel to the long dimension of the lid maximizes the path of the combusted air and gas mixture in the high heat chamber, thereby increasing the exposure of combusted gas products to the catalyst, maintaining a constant flow of combusted gases through the retort tubes, and enhancing the uniformity of heat radiated from the retort tubes by the combusted gas products. Increasing the length of the retort tube advantageously increases the amount of catalyst which undergoes an endothermic reaction with combusted gas products thereby generating an excess supply of oxygen-free gas. Increasing the amount of gas which is reacted can possibly generate a supply of furnace atmosphere to provide two furnaces with a controlled furnace atmosphere.

Additional advantages and features of the present invention will become apparent from the subsequent description and the appended claims taken into conjunction with the accompanying drawings:

DETAILED DESCRIPTION OF THE PREFERRED EMBODIMENT

Figure 1:
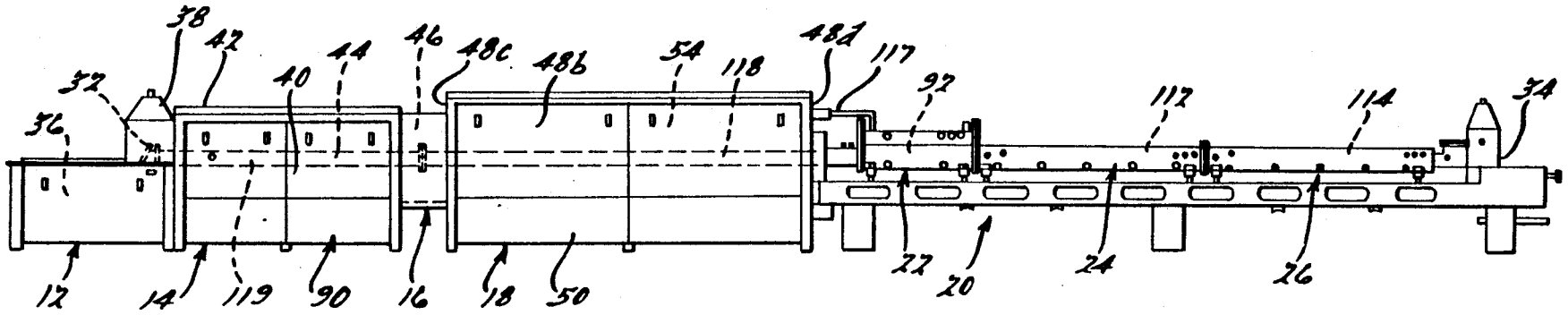
FIG. 1 shows a side elevation view of an endothermic furnace including a high heat assembly and a first cooling assembly and embodying the principles of the present invention.
Figure 2:
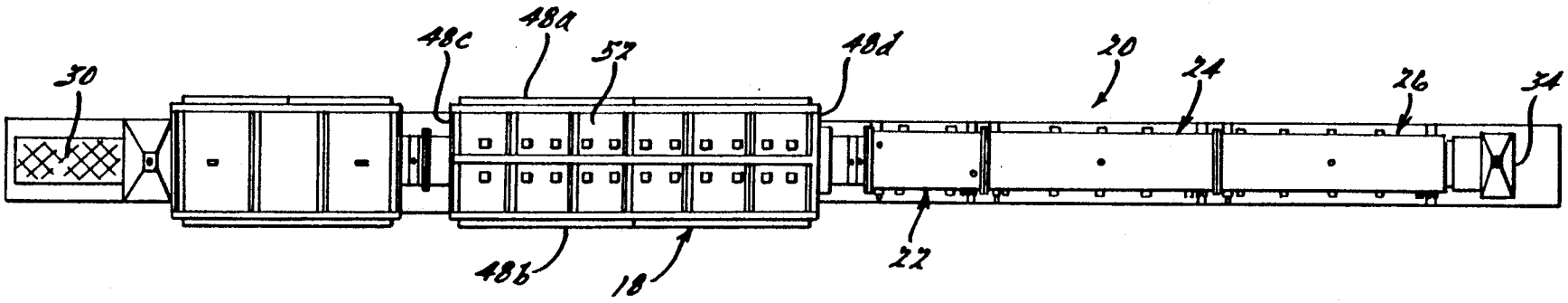
FIG. 2 is a top plan view of the furnace.
Figure 3:
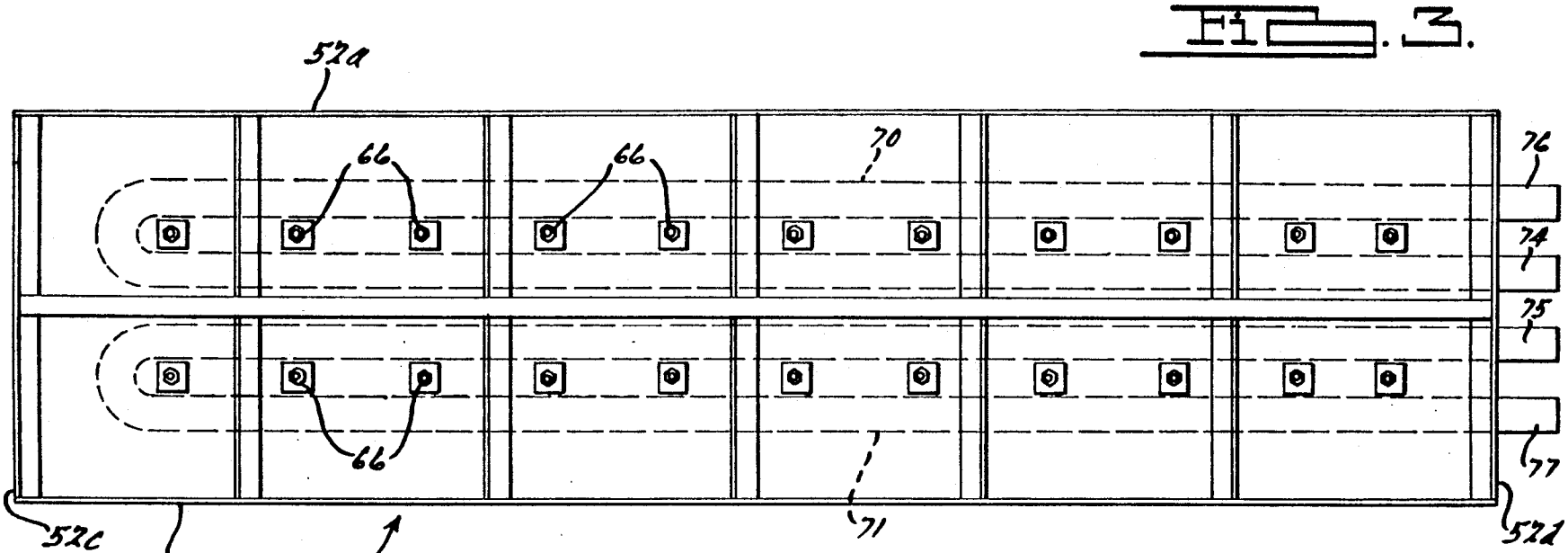
FIG. 3 is a top plan view of a lid assembly adapted to be removably mounted on the high heat assembly of the furnace shown in FIG. 1 and showing (in phantom) a pair of U-shaped retort tubes.
Figure 4:
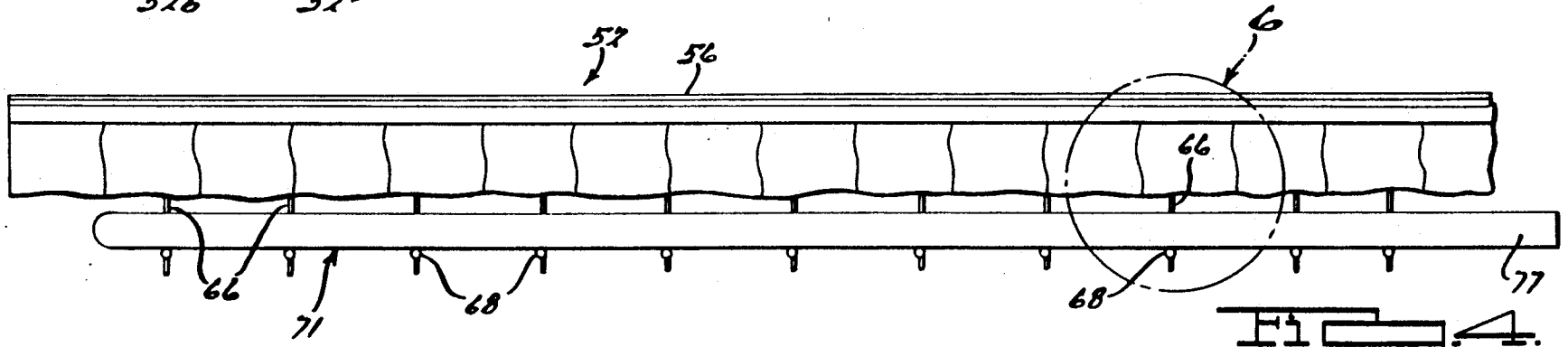
FIG. 4 is a vertical side elevation view of the lid assembly.
Figure 5:
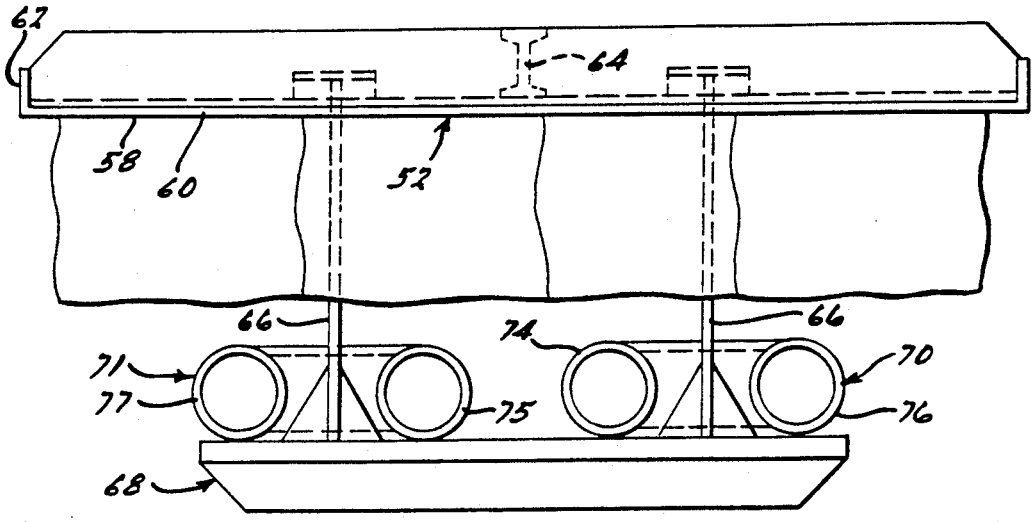
FIG. 5 is a vertical end elevation view of the lid assembly.
Figure 6:
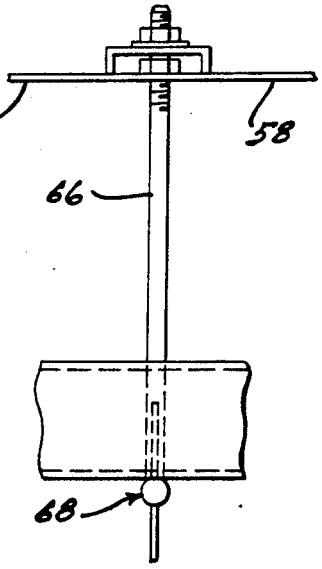
FIG. 6 is a view showing detail of a support member for supporting the retort tube on the lid assembly.
Figure 7:
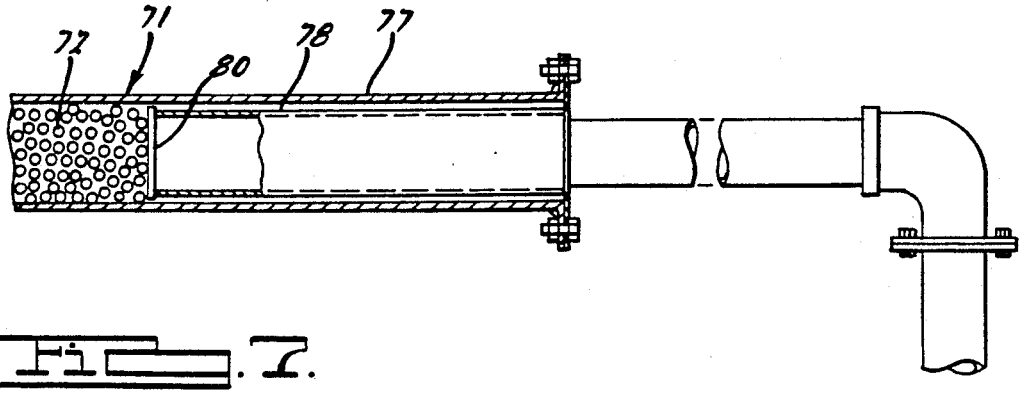
FIG. 7 is a fragmentary cross-section view of a retort tube containing a catalyst therein.
Figure 8:
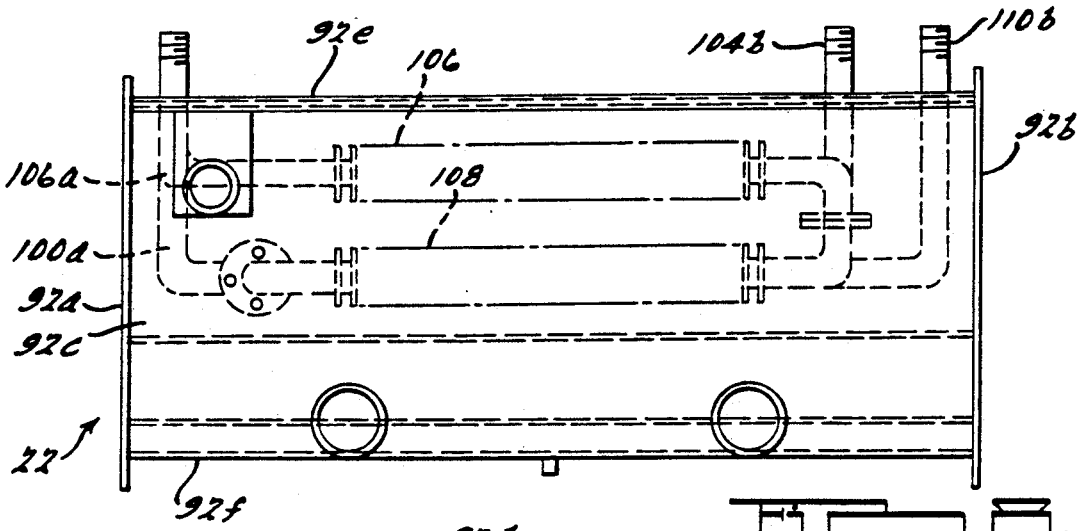
FIG. 8 is a vertical side elevation view of the first cooling assembly including a cooling chamber.
Figure 9:
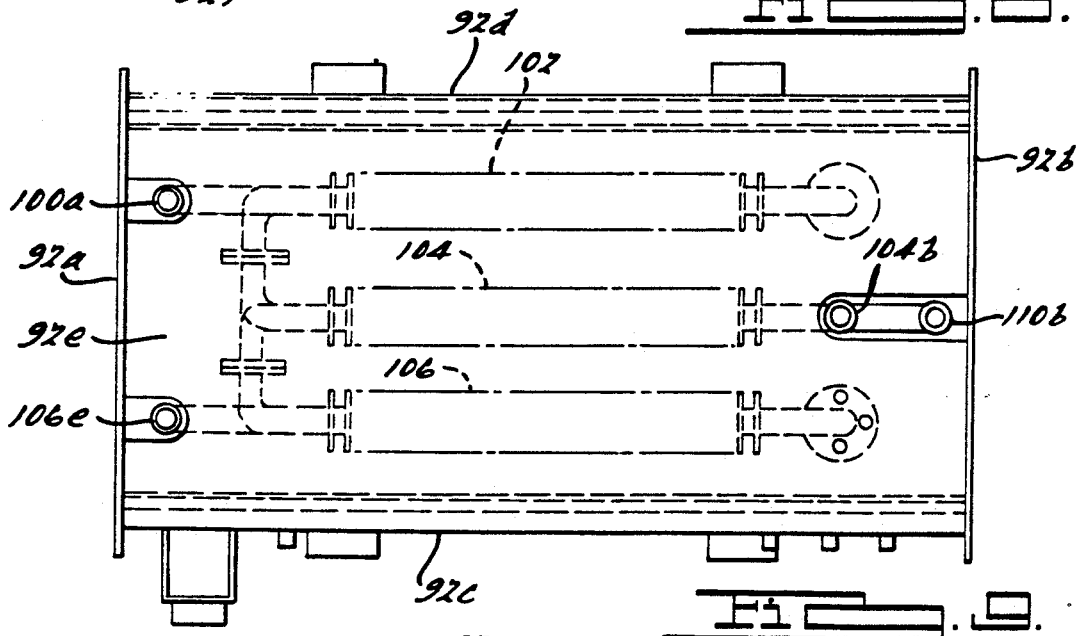
FIG. 9 is a top plan view of the cooling assembly.
Figure 10:
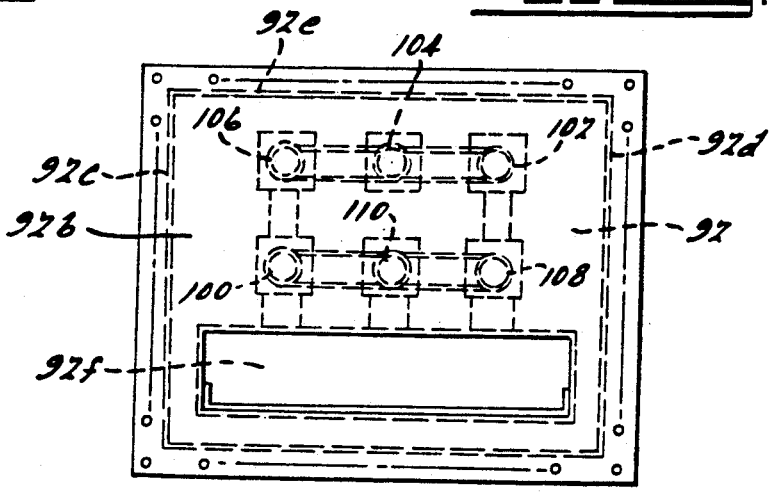
FIG. 10 is a vertical end elevation view of the cooling assembly.
Figure 11:
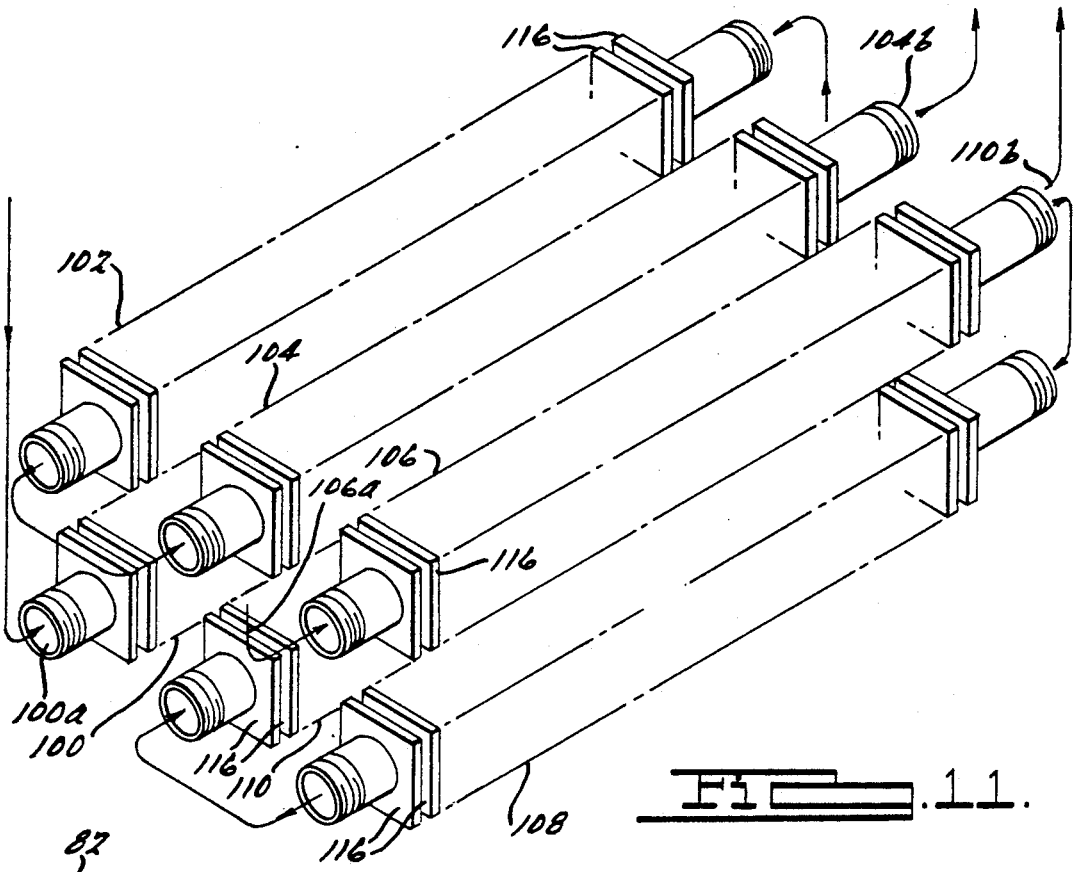
FIG. 11 is a perspective view of an array of cooling tubes disposed in the cooling chamber.

A sintering furnace for bonding metal particles together may be of any suitable construction and is illustrated herein by the number 10 as comprising a driveable assembly 12, a preheat assembly 14, a high heat assembly 18, a transition assembly 16 interconnecting the preheat and high heat assemblies, and a cooling assembly 20 extending from the high heat assembly and comprising a series of three cooling sections 22, 24 and 26. Each of the assemblies define suitably dimensioned chambers, the workpieces being carried through the furnace chambers by a conveyor 30 which receives the untreated workpieces at an inlet 32 defined by drivetable assembly 12 and discharges the heat treated workpieces at an outlet 34 defined at the third cooling section 26.

A combustible mixture of carbonaceous fuel gas and air is reacted in a retort to heat the furnace chamber and to react with a catalyst in the retort to provide a reducing atmosphere for use in the chambers of the preheat, high heat and cooling assembly. A conduit arrangement 117 and 28 passes the heated reaction gas (i.e., reducing atmosphere) into the cooling sections for cooling and then back into the high heat and cooling assemblies.

Drivetable assembly 12 includes a pair of vertical endwalls, a pair of vertical sidewalls, and a pair of horizontal walls one defining a base and the other a top cover, the walls defining an oblong chamber 36. A flue 38 extends from the cover for venting gases from the preheat zone. In the drivetable assembly, the workpieces are loaded onto a continuous belt and advanced to the preheat assembly.

Preheat assembly 14 includes a pair of vertical sidewalls, a pair of vertical endwalls and a pair of horizontal walls, a base 40 and a top lid 42, the walls forming a sealed chamber 44. Within this preheat assembly is a sealed preheat muffle 119, located between drivetable assembly 12 and transition assembly 16. The preheat assembly preheats the workpieces in chamber 44 and preheat muffle 119, to 1600° F. for the purpose of removing the lube or wax used during the compaction operation to prevent the metal powder from galling the metal tooling.

Transition assembly 16 includes a pair of vertical sidewalls, a pair of vertical endwalls and a pair of horizontal walls including a base and a lid, the walls cooperating to form a sealed chamber 46. The transition section functions to connect the preheat chamber to the high heat chamber and to transport the workpieces into the high heat assembly.

High heat assembly 18 comprises a generally rectangular enclosure having a pair of vertical sidewalls 48*a* and 48*b*, a pair of vertical endwalls 48*c* and 48*d*, and a pair of horizontal walls including a base 50, and a planar lid 52 removably secured to the vertical walls thereof, the walls cooperating to define a sealed chamber 54. Within this high heat assembly is a sealed high heat muffle 118 to sinter the workpieces. The form and structure of the walls are conventional and will not be described.

The lid is generally elongated and rectangular in shape and includes opposite lateral edges 52*a* and 52*b* and longitudinal edges 52*c* and 52*d*, an exterior top surface 56 and a unitary flat sheet 60 comprised of steel and forming a bottom surface 58, the sheet 60 facing the chamber interior and ending in vertical lips 62. One or more reinforcing member such as I-beam 64 are provided to rigidify the lid. Removability of the lid 52 from the furnace and replacement is easily accomplished by an overhead hoist or the like.

Extending from the bottom surface 58 of lid 52 for disposition in the furnace chamber 54 are a plurality of support brackets 66, a plurality of horizontally disposed support platforms 68 and a pair of horizontally disposed longitudinally extending U-shaped retort tubes 70 and 71, each retort tube being supported by platforms 68 and each being filled with a bed of catalyst 72. The support brackets 66 are disposed in two longitudinally extending and laterally spaced rows with each bracket being suitably secured through sheet 60 into lid 52. A support platform 68 extends laterally between respective pairs of support brackets 66 to supportingly suspend each of the two retort tubes 70 and 71. The retort tubes are in a common horizontal plane generally parallel to and vertically spaced from lid 52 and base 50. By this configuration retort tubes 70 and 71 provide maximum uniform heat radiation throughout the sintering chamber 54.

Each retort tube 70 and 71 has, respectively, an inlet end 74 and 75 and an outlet end 76 and 77 with both inlet ends 74 and 75 and outlet ends 76 and 77 being adjacent edge 52*d* of the lid and of sufficient extension to extend through endwall 48*d* and outwardly of the furnace. A longitudinally extending cylindrical spacer 78 terminates the ends 74, 76 and 75, 77 of each respective retort 70 and 71, each spacer extending axially inward from its respective tube end to terminate in an apertured disk 80 configured to pass combustible or reaction gases and simultaneously prevent catalyst movement. The spacer 78 functions to support the tube and ensure that catalyst is positioned fully within the high heat area (i.e., 1800°-2200° F. area) of the furnace. The catalyst 72, such as platinum or nickel oxide, extends uniformly through each retort tube. Each retort tube is preferably of heat resisting alloy or silicon carbide. The retorts are supported in the high heat region of reaction chamber 54 and heated in the range of about 1800° F.-2200° F. Should retort tubes 70 and 71 crack during their use, the convenient removability of lid 52 permits user access into furnace chamber 54 to remove, inspect, or repair the tubes.

A supply of air 82 and carbonaceous fuel gas 84 are supplied to a mixer 86 exterior of the furnace. A compressor 88 forces the combined gas mixture into retort tubes 70 and 71 at respective inlets 74 and 75 thereof whereupon the gas mixture passes through catalyst 72 in each of the retort tubes and to respective outlets 76 and 77. An external heat source 90 is used to raise the temperature of chamber 54 to a level sufficient that the catalyst will be hot enough to combust the gas mixture. The gas mixture is combusted in the retort tubes thereby producing radiant heat. The combustion gases undergo an endothermic reaction with the catalyst to produce a desired endothermic reaction gas for use as a protective atmosphere.

The external heat source 90 heats furnace chamber 54 to approximately 2050° F. A significant feature of the retort arrangement is that by locating the retort in the existing high heat area of the furnace chamber 54, once the retort is heated to above 1800° F., it requires very little energy to maintain the retort temperature. As a result the cost of producing the endothermic atmosphere is less than that used by existing processes wherein a separate generator is used, which approach requires a separate heating system.

The first cooling section 22 is a generally oblong, rectangularly configured watertight enclosure having a pair of vertical endwalls 92*a* and 92*b* and vertical sidewalls 92*c* and 92*d*, and a lid 92*e* for keeping contaminants out of the water. A watertight muffle 92*f* extends through the section 22 and provides a tunnel through which the workpieces pass. The walls define a closed chamber 92.

A cooling arrangement comprises six cooling tubes 100, 102, 104, 106, 108 and 110 having their axes aligned to form a generally rectangularly disposed tube bundle and respective ends of the cooling tubes being interconnected in a pattern to form two sets of three cooling tubes. As shown, the first set comprises tubes 100, 102 and 104 and the second set comprises tubes 106, 108 and 110. Tubes 100 and 106 have, respectively, an inlet 100*a* and 106*a* to receive the heated endothermic gas from the retort outlets 76 and 77 and tubes 104 and 110 have outlets 104*b* and 110*b* to discharge cooled gas to the work area inside muffle 118, 119, and 92*f*. As shown, heated gas from the catalyst is first received by and passed through tubes 100 and 106, then passed into and through the second tubes 102 and 108, then passed into and through the third tubes 104 and 110, then discharged outwardly from the outlets 104*b* and 110*b* and into gas tight chambers 118, 119, 112 and 114, through pipe 120 of the preheat muffle, high heat muffle, and second and third cooler sections 24 and 26, and then discharged through flue 38. The tubes 100, 102, 104, 106, 108 and 110 of the heat exchanger bundle have thin fins 116 to increase the rate of cooling with each set of three tubes being used to cool combusted endothermic gases from one or the other retort.

The endothermic reacted gas is water cooled to below 150° (65° C.) in the first cooling chamber 22 and piped into the work area of the furnace where metallurgical sintering processes are being done on the workpieces. The cooled gas is preferably cooled at least to 150° F. and as low as 100° F. to achieve a stable protective atmosphere.

Figure 12:
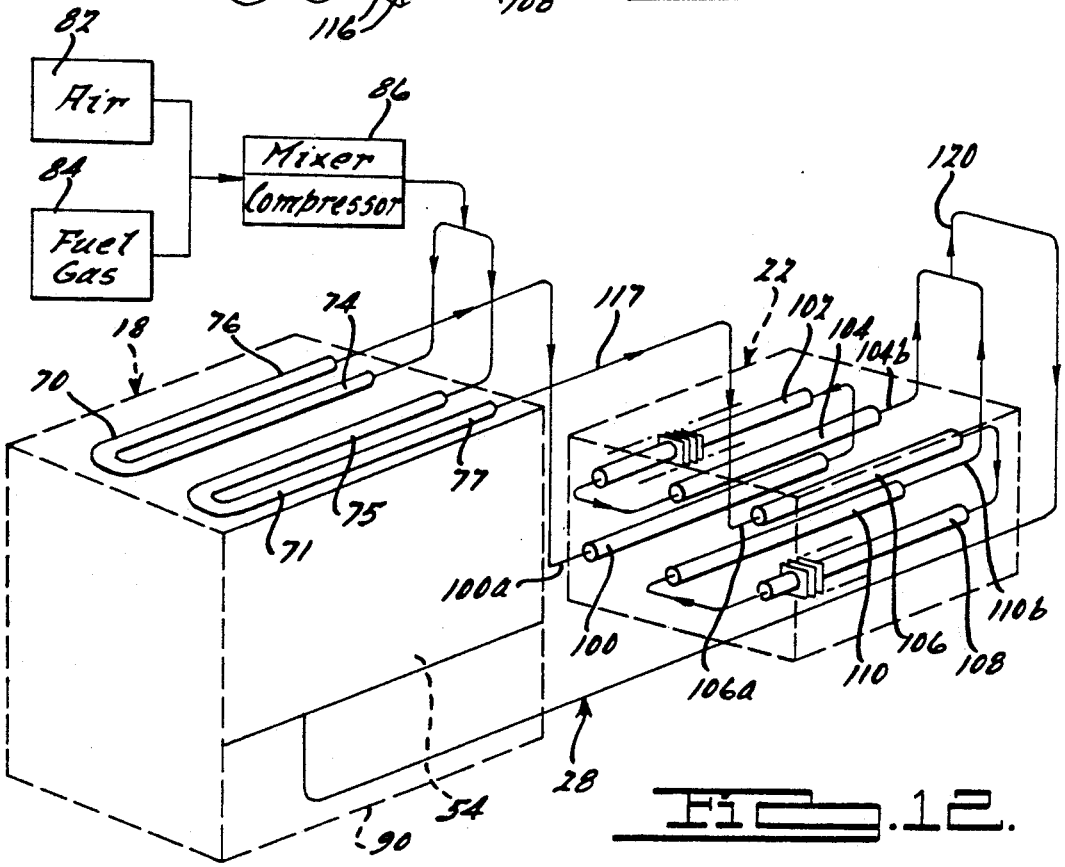
FIG. 12 is a schematic showing an air/gas mixture being converted during an endothermic gas reaction to provide a reducing atmosphere used during heat treating of a metal workpiece in the high heat assembly.

Referring to FIG. 12, cooled endothermic reaction gas from the first cooling chamber 22 is returned to the preheat, high heat and cooling work areas of the furnace. This return of endothermic gas is achieved by piping the gas through pipe 120 and a flow meter (not shown) to meter the amount of processed gas to proper proportions.

In one application, lid 52 was about 189 inches by 49 inches and each retort tube 70 and 71 had a diameter of 4.5 inches. The retort tubes defined a catalyst path of 154 inches through a catalyst 72 of nickel oxide. While more or fewer support brackets 66 could be utilized, in the embodiment shown, two rows of eleven longitudinally spaced brackets were used.

A pressurized air-gas mixture ratio in the range 2.2:1 to 3.2:1 is passed through the nickel oxide catalyst bed contained in the U-shaped retort tubes 70 and 71, externally heated to 1800°-2200° F. (982°-1204° C.) to produce an atmosphere in accordance with the following overall endothermic (heat absorbing) reaction.

$$2CH_4 + \text{air } (O_2 + 3.8N_2) = 2CO + 4H_2 + 3.8N_2$$

The completely reacted gas is discharged to the heat exchanger (tube bundle 100, 102, 104, 106, 108 and 110) and rapidly cooled to below 150° F. (65.5° C.), possibly to as low as 100° F. (37.8° C.), to prevent the formation of soot which forms upon cooling in the range from 1300°-900° F. (700°-480° C.), in accordance with the following reversible reaction:

$$2\,CO = C + CO_2$$

Accurate control of the process is possible by variation of the air:gas ratio to produce a neutral reducing atmosphere which is rich in hydrogen and nitrogen, free of oxygen and carbon dioxide and having a negligible amount (if any at all) of undesirable methane. Although natural gas (i.e., methane, $CH_4$) is most generally available, and hence is used in the illustration above, it is to be understood that other hydrocarbons, such as propane and manufactured gas, may be employed.

In one process, metal workpieces were exposed in chamber 54 to the heated endothermic atmosphere for approximately 30 minutes and in the cooling assembly 20 for about 3 hours. The difference in exposure times advantageously allows the metal workpieces to cool below the oxidation point before exiting the protective atmosphere and cool enough to handle.

The composition of endothermic reaction gas is conveniently controlled by determination of the dew point (moisture content) of the completely reacted gas in the furnace chamber at the operating temperature. In accordance with this invention the furnace atmosphere has a dew point of about 25° F. to 60° F. (−4° C. to 16° C.). Further, in accordance with this invention, a ratio of air:gas should be in the range varying between 2.2:1 to 3.2:1. For example, a gas having an air:gas ratio of 2.4:1 is very dry having a dew point of +10° to −10° F. (−12° to −23° C.), without the need of auxiliary drying equipment. Generally when the air:gas ratio is 2.75:1 to 4.5:1, the gas may be wet and could need an auxiliary dryer. It is known that the lower the dew point of the endothermic gas the higher the carbon potential, and vice versa. If the carbon potential of the gas is not in equilibrium with the carbon content of the metal, then the gas may either carburize or decarburize the workpieces.

The desirability of generating an endothermic gas atmosphere for the sintering process resides in the provision of a consistent atmosphere which can be maintained to provide a carbon potential in equilibrium with the carbon content of the powdered metal being sintered in the furnace, hence preventing unintentional carburization or decarburization. Further, previously wasted products of combustion from the indirect heated (and fired) U-tube retorts provides the desired furnace atmosphere.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A metal heat treating furnace including heating and cooling chambers wherein workpieces are to be respectively heated and cooled with each chamber being substantially airtight and provided with a predetermined atmosphere, comprising a lid removably mounted to said furnace;

a U-shaped retort tube horizontally disposed in the heating chamber for receiving a carbonaceous gas mixture, said retort including a catalyst which when heated reacts with the gas mixture to provide a reacted gas product which is substantially free of oxygen but rich in hydrogen and which provides heat to the heating chamber;

a heat exchanger including a tube bundle in the cooling chamber for receiving and cooling the reacted gas product, said exchanger having an inlet for receiving the reacted gas at its combusted high temperature and an outlet for discharging the gas at a substantially lower temperature; and conduit means for connecting the discharge outlet to the high heat chamber whereby to supply a substantially oxygen free atmosphere for use in the furnace chambers.

2. The furnace as recited in claim 1 wherein said airtight heating chamber is formed by said lid, a base and opposed vertical pairs of sidewalls and endwalls with respective vertical end portions of said walls being connected to respective edges of said lid and said base, further characterized by releasable means for removably securing the lid edges to said end portions, each end of the U-shaped retort tube being disposed adjacent one said wall.

3. The furnace as recited in claim 1 wherein a pair of U-shaped retort tubes are supported from the lid in side-by-side relation with each tube being generally disposed in a common plane with individual tubes forming the "U"-shape being parallel to the longitudinal edges of the lid.

4. The furnace as recited in claim 1 wherein the heat exchanger comprises a plurality of selectively interconnected elongated cylindrical cooling tubes the axes of each being parallel to one another and disposed in a plane parallel to a plane including the U-tube.

5. The furnace as recited in claim 3 wherein the heat exchanger comprises a first and second set of elongated, cylindrical, externally finned, cooling tubes the ends of the cooling tubes in each set being selectively interconnected such that one cooling tube includes an inlet to receive the reacted gas from the discharge outlet and another cooling tube includes an outlet connected to the conduit means.

6. The furnace as recited in claim 5 wherein each set includes at least three cooling tubes with the axes of the cooling tubes being in orthogonal planes.

7. A furnace including an oblong chamber for sintering metal, comprising heating means for heating the chamber, a retort tube containing a catalyst which reacts with a mixture of carbonaceous fuel and air to create an endothermic atmosphere, one and the other end of said retort tube defining, respectively, an inlet for receiving the gas mixture and an outlet for discharging the endothermic atmosphere, means for combusting the mixture, support means, including a lid removably mounted to the furnace, for suspending the retort tube in said chamber, and cooling means connected to the discharge outlet for cooling and piping the endothermic atmosphere into the chamber.

8. The furnace as recited in claim 7 wherein the retort tube is U-shaped and said lid is generally flat and rectangular in shape, the retort being suspended from the lid in such manner that the lid and the retort tube are in spaced horizontal planes.

9. The furnace as recited in claim 8 comprising a pair of U-shaped retort tubes disposed in side-by-side relation each being disposed in a common plane that is generally parallel to and spaced from the lid.

10. The furnace as recited in claim 9 wherein each retort tube extends longitudinally relative to the long dimension of the lid and the ends of each tube are adjacent one end of the lid.

11. The furnace as recited in claim 7 wherein said cooling means comprises an airtight cooling chamber having a heat exchanger formed from a set of cooling tubes, the ends of said cooling tubes being selectively interconnected to form a continuous passage between an inlet thereof to receive heated combusted gases from the discharge outlet and an outlet thereof connected to a return pipe to communicate the cooled gases back to the chamber to form the atmosphere therefor.

12. The furnace as recited in claim 7 wherein the heating means comprises the gas mixture being combusted exteriorly of the chamber and the combusted gas passed directly into the retort tube whereby to react with the catalyst to form a heated endothermic atmosphere and heat the tube whereby to radiate heat to the chamber.

13. The furnace as recited in claim 7 wherein said heating means comprises an external heater which heats the chamber and acts to heat the catalyst in said retort tube to a level sufficient to initiate combustion of the gas mixture thereby to react with the catalyst to form a heated endothermic atmosphere and heat the tube whereby to radiate heat to the chamber.

14. The furnace as recited in claim 11 wherein said cooling means further comprises a second airtight cooling chamber connected to the other airtight chamber for water cooling of the combusted gas product.

15. A high temperature furnace for sintering metal, comprising a high temperature chamber, a retort in the chamber for passing a carbonaceous gas mixture therethrough, means for removably mounting said retort in said chamber including a lid removably attached to said chamber, said retort including a catalyst which reacts with the gas mixture to create an endothermic atmosphere, and cooling means, connected to the retort, for cooling the heated endothermic atmosphere and communicating same back into the chamber to provide a protective environment for the metal when in the chamber.

16. The furnace as recited in claim 15 including heating means, external of the chamber, for heating the catalyst to a level sufficient to combust the carbonaceous gas mixture.

17. The furnace as recited in claim 16 wherein said retort comprises an elongated tube defining at its opposite ends an inlet and an outlet, respectively, for receiving the carbonaceous gas mixture and discharging the endothermic atmosphere therefrom, the ends of the tube being adjacent said cooling means.

18. The furnace recited in claim 17 wherein the tube is generally U-shaped.

19. The furnace as recited in claim 15 wherein said lid covering the chamber and said retort being connected to said lid thereby to be suspended in said chamber.

20. The furnace as recited in claim 19 wherein said lid is generally rectangular and said retort comprises a pair of U-shaped tubes, each tube being suspended from the lid in side-by-side relation.

21. The furnace as recited in claim 20 wherein each said tube includes an inlet and an outlet, respectively, for receiving the carbonaceous gas mixture and passing the endothermic atmosphere outwardly of the retorts, and means for connecting the outlets to said cooling means.

22. The furnace as recited in claim 21 wherein the inlet and outlet for each said tube is adjacent one end of the lid.

* * * * *